US005639030A

United States Patent [19]

Watajima et al.

[11] Patent Number: 5,639,030

[45] Date of Patent: Jun. 17, 1997

[54] VERTICAL SHAFT IMPACT CRUSHER AND OPERATING METHOD THEREFOR

[75] Inventors: Teruji Watajima, Takeo; Hiroshi Nakayama, Urayasu, both of Japan

[73] Assignee: Nakayama Iron Works, Ltd., Takeo, Japan

[21] Appl. No.: 419,545

[22] Filed: Apr. 10, 1995

[30] Foreign Application Priority Data

Apr. 12, 1994 [JP] Japan ..... 6-098155

[51] Int. Cl.[6] ..... B02C 19/00

[52] U.S. Cl. ..... 241/30; 241/275

[58] Field of Search ..... 241/275, 189.1, 241/188.1, 30

[56] References Cited

U.S. PATENT DOCUMENTS

| | | | |
|---|---|---|---|
| 3,652,023 | 3/1972 | Wood | 241/275 |
| 3,767,127 | 10/1973 | Wood | 241/275 |
| 4,390,136 | 6/1983 | Burk . | |
| 4,756,484 | 7/1988 | Bechler et al. | 241/275 |
| 4,844,354 | 7/1989 | Watajima . | |
| 5,135,177 | 8/1992 | Okuhara | 241/275 |

FOREIGN PATENT DOCUMENTS

| | | |
|---|---|---|
| 2593723 | 8/1987 | France . |
| 9015362 | 1/1991 | Germany . |

*Primary Examiner*—Mark Rosenbaum
*Attorney, Agent, or Firm*—Armstrong Westerman Hattori McLeland & Naughton

[57] ABSTRACT

A combination of anvils in a vertical shaft-type impact crusher with deadstock spaces enables the extension of life of the tips mounted on a rotor. A combination of hard tips with softer tips overcomes the inconsistency in which the hard tips that are prone to wear by chipping but are erosive resistant to collision with stones of a large grain size accelerated by the rotor, while the softer tips are resistant to chipping-wear but are ordinarily prone to erode by collision with stones of a smaller grain size accelerated by the rotor. Crushers having anvils and dead stock spaces, have pairs of symmetrically arranged hard tips and softer tips mounted on a reversibly rotatable rotor. The pairs of tips are located in symmetry with respect to each of a number of angularly related centerlines extending radially from the rotational axis of the rotor.

7 Claims, 4 Drawing Sheets

VERTICAL SHAFT IMPACT CRUSHER AND OPERATING METHOD THEREFOR

BACKGROUND OF THE INVENTION

The present invention relates to a vertical shaft-type impact crusher and an operation method for a vertical shaft-type impact crusher. More particularly, the present invention relates to a vertical shaft-type impact crusher and an operation method for a vertical shaft-type impact crusher for crushing bulk materials, for example, natural rock, into grains or particles of desired size.

Bulk materials, e.g., natural rock, are crushed in accordance with various uses, for example, aggregate for concrete, paving stone, subgrade material, etc. One type of crusher used for such a crushing process is known as a vertical shaft-type impact crusher.

Impact crushers operate on the basis of the principle that rock is accelerated at a high speed so as to collide with an impact surface, thereby crushing the rock. Such impact crushers may be generally divided into two types according to the mode of crushing: anvil-type and dead stock-type.

The anvil-type impact crusher includes a rotor having a plurality of wings or blades on the upper side thereof which are rotated at a high speed, whereby raw stones east into the crusher are accelerated by the blades and centrifugally discharged so as to collide with anvils which are disposed annularly around the rotor, thereby crushing the raw stones.

Such an anvil-type impact crusher is mainly used for the purpose of crushing raw stones having a relatively large diameter by collision to thereby reduce the size of the raw stones.

On the other hand, a dead stock-type impact crusher is mainly used to smooth surfaces of raw stones which have already been crushed into gravel of desired size and to make the grain size uniform. Such a dead stock-type impact crusher is similar to the anvil-type impact crusher in that the raw stones are centrifugally accelerated by blades, but different from the latter in that dead stocks are formed from crushed raw stones at the periphery of the rotor, and the surfaces formed by this dead stock have angles of rest which are used as impact surfaces for crushing raw stones.

Aggregate for concrete is required to be made of crushed stone of a large grain size and crushed sand of small grain size. According to JIS (Japanese Industrial Standard), it is required for both stone and sand to be in given definite grain size distributions. The distribution of Crushed Stone JIS 5005 is defined as the weight-percentage of stones passing through sieves as follows:

| | |
|---|---|
| 60 mm: | 100%; |
| 50 mm: | 95 to 100%; |
| 25 mm: | 35 to 70%; |
| 15 mm: | 10 to 30%; and |
| 5 mm: | 0 to 5%. |

It is difficult for an anvil-type impact crusher to produce stones of a large grain size and to produce stones having good shape, while it is difficult for a dead stock-type impact crusher to produce stones of a small grain size.

A further problem is that tips are worn by accelerated stones. A rotor is provided with pairs of tips mounted on the wings thereof. Stones of a large size, the diameter of which is larger than 40 mm, generate more chipping-type wear than stones of a small size. Material harder to chip is preferably applied for tips which are used in a crusher for crushing stones of a large size. Stones of small size, the diameter of which is smaller than 40 mm, generate more erosive-type wear than stones of a large size. A higher degree of erosive wear-resistant material is preferably applied for tips which are used in a crusher for crushing stones to a small size. As such, there is an inconsistency in the tips used in impact crushers for large sized stone-crushing and those used for small sized stone-crushing.

SUMMARY OF THE INVENTION

An object of the present invention is to provide a vertical shaft-type impact crusher for crushing stones of various sizes which overcomes the inconsistency of stones of a large size generating more chipping-type wear than those of a small size, thereby material hard to chip being preferably applied for tips which are used in a crusher for crushing stones of a large size, while stones of a small size generate more erosive-type wear than stones of a large size, thereby a higher degree of erosive-type wear-resistant material being preferably applied for tips which are used in a crusher for crushing stones of a small size.

Another object of the present invention is to provide a vertical shaft-type impact crusher for crushing stones of various sizes which has a high production efficiency.

Still another object of the present invention is to provide an operation method for a vertical shaft-type impact crusher for crushing stones of various sizes in which the life of the tips is extended.

Still another object of the present invention is to provide an operation method for a vertical shaft-type impact crusher for crushing stones of various sizes in which a plurality of the crushers are simultaneously operated, whereby the production efficiency is high.

Still another object of the present invention is to provide an operation method for a vertical shaft-type impact crusher for crushing stones of various sizes in which a plurality of crushers are simultaneously operated, whereby the life of tips is extended.

In one aspect of the invention, the vertical shaft-type impact crushers have a rotor mounted on a casing body, the rotor being reversely rotatable for giving thrown stones centrifugal force, and anvils for crushing stones discharged from the rotor. The anvils are mounted in the circumferential area around the rotor. Dead stock spaces for crushed stones to be accumulated therein are located in the circumferential area around the rotor. The anvils are located between the respective intervals given in the peripheral direction around the rotor.

In the above aspect, the vertical shaft-type impact crushers have a dead stock-forming plate for forming dead stock spaces thereabove. The dead stock-forming plate surrounds the rotor and has a bore in which the rotor is located.

Also vertical shaft-type impact crusher of the invention has an adjustable means for adjusting the distance between the respective anvils and the rotor, the adjustable means being located between the respective anvils and the inner surface of the casing body.

In the above aspect of the vertical shaft-type impact crusher, the bore is circular, and furthermore, has a ring for adjusting the volume of the dead stock space. The ring is replaceably mounted on the peripheral edge of the circular bore.

In another aspect of the invention, the vertical shaft type-impact crusher has a rotor mounted on the casing body. The rotor is reversely rotatable for giving thrown stones centrifugal force. The vertical shaft-type impact crusher has anvils mounted in the circumferential region around the rotor. The rotor includes multiple pairs of tips, the respective pairs of tips being located symmetrically with respect to the angularly oriented radial axes disposed at equal angular intervals. The axes extend from, and are perpendicular in the radial direction to, the rotational axis of the rotor. The respective tips of the respective pairs, which point forward in the rotational direction with respect to the respective radial axes, are made of hard material in comparison with material that follows. The respective tips of the respective pairs, which point backward in the rotational direction with respect to the respective axes, are made of softer material in comparison with the above hard material.

In another aspect of the invention, in an operation method for the vertical shaft-type impact crusher, hard material is employed for the forward-pointing tips mounted in the respective dead stock spaces in which respective dead stocks are formed on the rotor rotated in the forward rotational direction, and softer material is employed for the front tips mounted in the respective dead stock spaces where respective dead stocks are formed on the rotor rotated in the reverse rotational direction. The rotation of the rotor in the forward direction, or in the reverse direction, is operated in response to the grain size of the raw stones supplied to the crusher.

In the above aspect of the invention, in the operation method for the vertical shaft-type impact crusher, the rotor is rotated in the forward direction in cases in which the grain size of raw stone is large and the rotor is rotated in the reverse direction in cases in which the grain size of raw stone is small.

In the above aspect of the invention, in the operation method for the vertical shaft-type impact crusher, the rotation of the rotor in the forward direction, or in the reverse direction, is operated in response to the degree of wear of the hard tips in comparison with that of the softer tips.

In the above aspect of the invention, in the operation method for the vertical shaft-type impact crusher when used in multiple numbers, the rotor of a first crusher into which stones of a large grain size are supplied is rotated in the forward direction, and the rotor of a second crusher into which stones of a small grain size are thrown down is rotated in the reverse direction.

In another aspect of the invention, the vertical shaft-type impact crusher has a rotor mounted on the casing body and which is reversely rotatable for giving thrown stones centrifugal force. The crushers have dead stock spaces for crushed stones to be accumulated therein. The dead stock spaces are located in the circumferential area around the rotor. The anvils for crushing stones discharged from the rotor are mounted in the circumferential area around the rotor. The respective anvils are located between the respective dead stock spaces with the intervals occurring in the peripheral direction around the rotor, while the rotor includes multiple pairs of tips, the respective pairs of tips being located symmetrically with respect to the angularly oriented axes disposed at equal angular intervals, the axes extending from the rotational axis line of the rotor in the radial direction. Respective tips of the pairs which point forward in the rotational direction with respect to the respective axes are made of hard material in comparison with material that follows. Respective tips of the pairs which point backward in the rotational direction with respect to the respective axes are made of softer material in comparison with the above hard material.

In the vertical shaft-type impact crushers of the present invention, stones are crushed by collision with not only anvils but also dead stocks. The dead stocks are formed with the respective angles of rest. Some stones are smoothed by the dead stocks, while the other stones are crushed into stones of a small grain size.

Stones of a large size collide with less hard tips, while stones of a small size collide with harder tips. The wear of the harder tips brought about by the collision with stones of a large size is less because of the rotation in the forward rotational direction. The wear of the softer tips brought about by the collision with stones of a small size is less because of the rotation in the reverse direction.

The other aspects and operations of the present invention are explained in detail through embodiments of the present invention as follows.

DETAILED DESCRIPTION OF EMBODIMENTS

Figure 1:
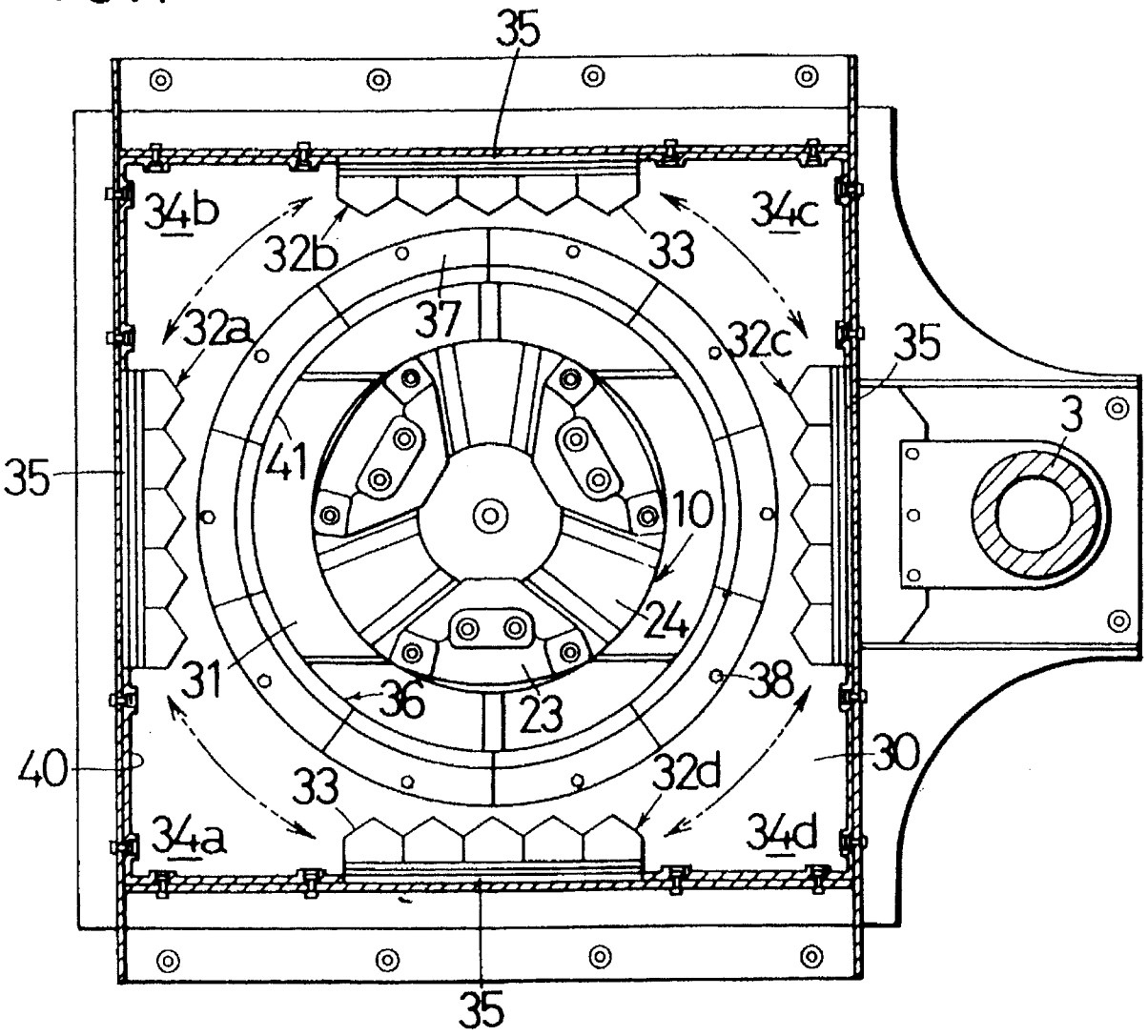
FIG. 1 is a top view of a first embodiment of a vertical shaft type impact crusher in accordance with the present invention.
Figure 2:
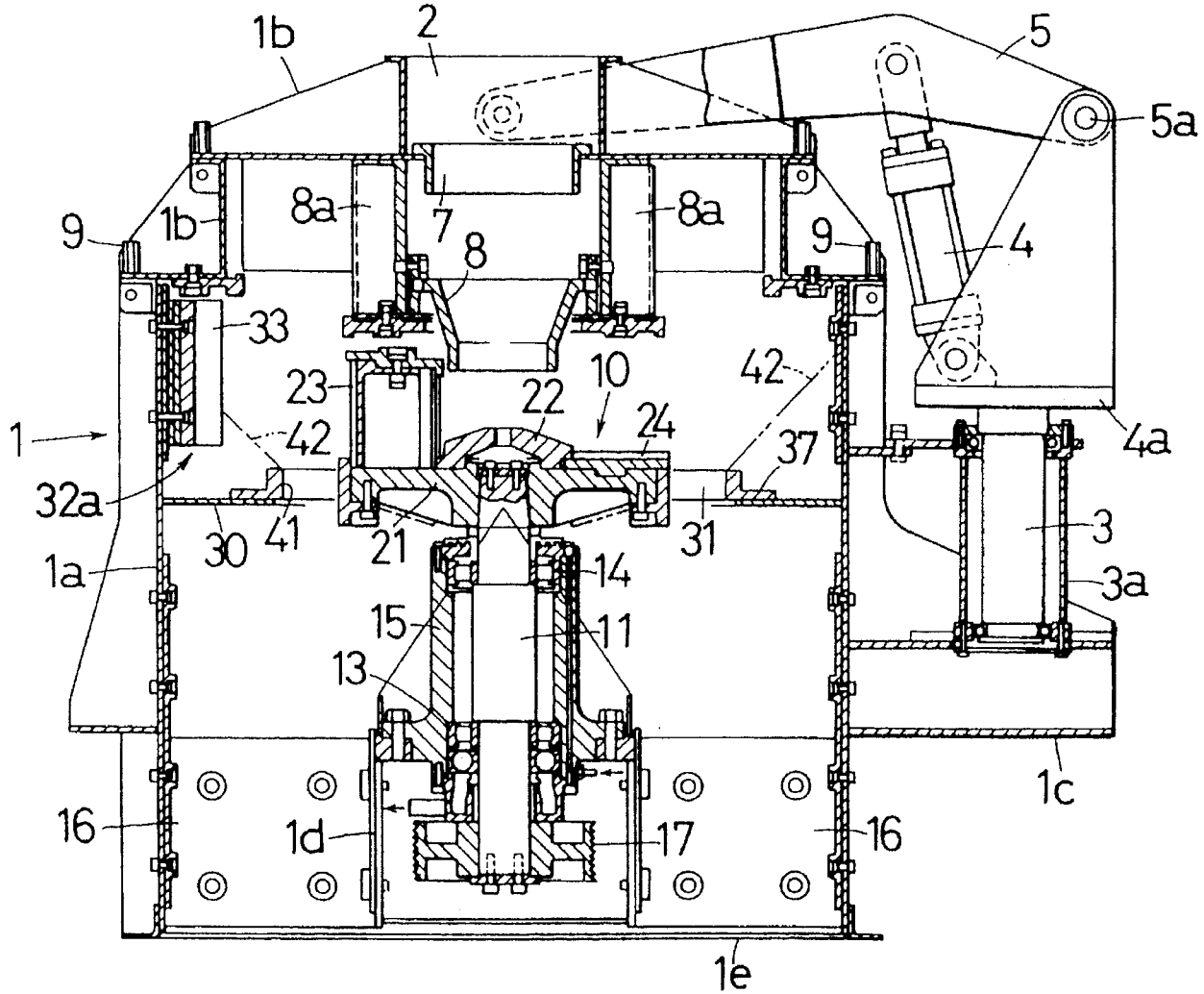
FIG. 2 is a cross-sectional view of the crusher of FIG. 1.

Referring now to the figures, an embodiment of a vertical shaft-type impact crusher constructed in accordance with the present invention is described in the following. FIGS. 1 and 2 illustrate a vertical shaft-type impact crusher. A casing 1 includes a casing body 1*a* and a covering lid 1*b*. Covering lid 1*b* is rotatably mounted on the upper portion of the casing body 1*a* by means of a mounting means (not shown).

Covering lid 1*b* is opened and closed relative to the casing body 1*a* by means of a lever 5 which pivots about a pivot axis and is forced upwardly and downwardly by a hydraulic cylinder 4. Covering lid 1*b* has an inlet opening 2. Two guide chutes 7 and 8 are located at the respective lower positions of the inlet opening 2, affixed to the suspended portion of the casing body 1*a*. Lower guide chute 8 is attached to a multiple number of vertically suspended, circumferentially spaced ribs 8*a*. Vertically suspended ribs 8*a* are provided as a portion of the casing body 1*a*.

A rotor 10 is located under the guide chute 8. Rotor 10 is mounted on a top surface of the vertical rotating shaft 11. Vertical rotating shaft 11 is rotatably supported in the axle-housing 15 through bearings 13 and 14. Axle-housing 15 is mounted on the casing body 1*a* through brackets 16. A pulley 17 is attached to the lower portion of the vertical rotating shaft 11. Pulley 17 is connected to a reversible motor (not shown) through a belt (not shown). Vertical rotating shaft 11 is rotated in alternate directions in response to the operation of the motor.

Rotor 10 includes a rotor body 21, a distributing cone-like body 22, three circumferentially spaced wings 23, 23, 23 and three pairs of liners disposed intermediate the respective wings. Distributing cone-like body 22 is mounted on the upper side of the central portion of the rotor body 21. The respective three wings 23, 23, 23 are adjustably positionable in three angular intervals of 120 degrees therebetween. Pairs of liners are placed between the respective wings in the respective 120 degree angular intervals. Casing 1 is generally square in the sectional view.

As shown in FIG. 1, four protecting liners 40 are fixedly mounted on the respective inner side surfaces of the respective walls forming the casing 1. A dead stock forming plate 30 is horizontally disposed in the casing body 1*a*. Dead stock forming plate 30 is designed as a square plate of which the peripheral edge portion is affixed against the inner surface of the casing body 1*a*.

As shown in FIG. 1, dead stock forming plate 30 has a circular opening 31, the diameter of which is designed to be larger than that of the rotor 10. Circular opening 31 and rotor 10 have a common central axis-line. Four anvils 32*a*, 32*b*, 32*c*, 32*d* are located upwardly apart from the dead stock forming plate 30. Respective anvils 32*a*, 32*b*, 32*c*, 32*d* have respective anvil members 33 affixed to the respective central portions of the inner surfaces of the casing body 1*a*.

Each anvil member is made of an erosive wear-resistant material, e.g., manganese steel. The locations of the anvils 32 create four dead stock spaces 34*a*, 34*b*, 34*c*, 34*d* formed therebetween. Respective dead stock spaces 34*a*, 34*b*, 34*c*, 34*d* are respectively provided as four corner portions partly forming the inner space of the casing 1.

Each horizontal distance between each anvil and the rotor 10 is adjustable as follows. Spacers 35 are replaceably inserted between the respective surfaces of the casing body 1*a* and the respective anvil members. The number of the spacers 35 enables the above distance in the horizontal direction to be adjustable.

The volume of the dead stock spaces 34*a*, 34*b*, 34*c*, 34*d* is also adjustable as follows. As shown in FIGS. 1 and 2, diameter-adjusting ring 36 is located at the circumferential edge of the circular opening 31. Adjusting ring 36 is circumferentially divided into a multiple of segments 37. Each segment is replaceably affixed to the dead stock forming plate 30 by means of a bolt 38.

A flange 41 is formed the inner circumferential edge portion of the respective segments 37. Many kinds of segment groups, the radii of which are different from one another, can be prepared. The replacement of the segment group allows the above volumes of the dead stock spaces 34 to be altered. A multiple number of single body rings may be used for altering the ring diameter.

Figure 3:
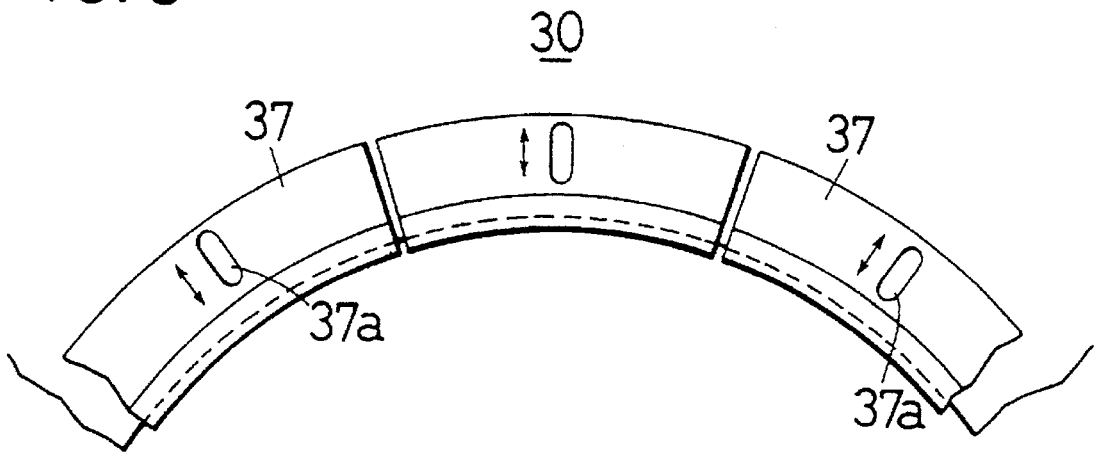
FIG. 3 is a top view of a dead stock space of another embodiment.

Another embodiment of a diameter-adjusting ring is illustrated in FIG. 3. Each segment 37 has an elongated hole 37*a* extending in the radial direction. The mounting position of the segment 37 relative to the dead stock-forming plate 30 is aligned in the radial direction. Each segment is secured to the dead stock-forming plate 30 by means of a bolt (not shown in FIG. 3) passing through the elongated hole 37*a*. In this case, a space is formed between adjacent segments 37, 37. Such spaces do not cause any problems because they become filled with crushed rocks.

Figure 5:
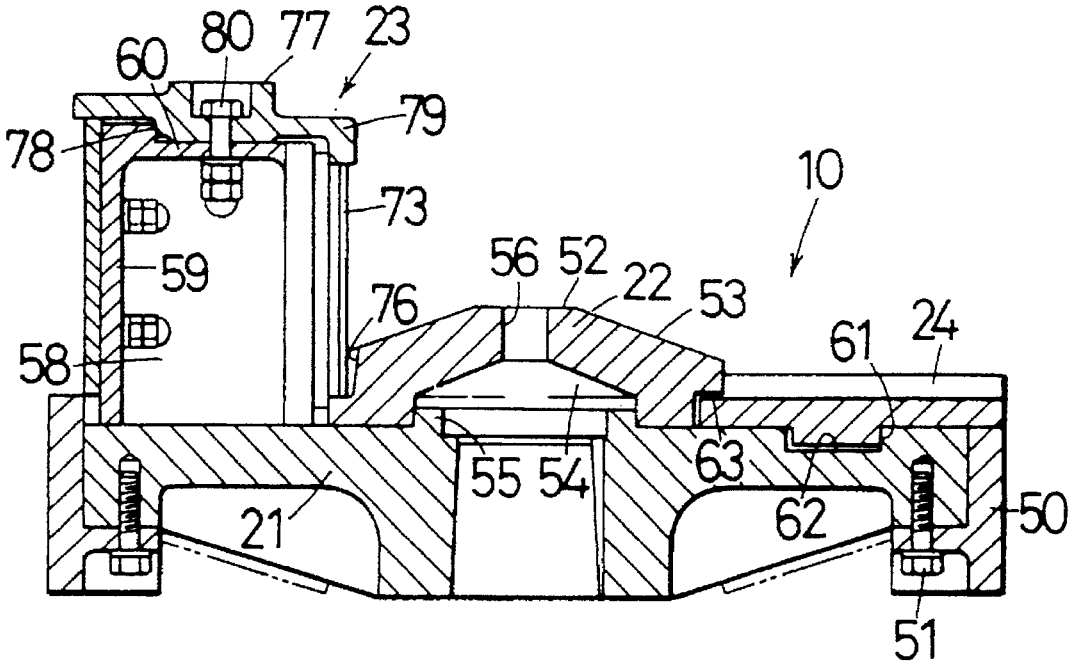
FIG. 5 is a vertical cross-sectional view of the rotor of the crusher of FIG. 1.
Figure 4:
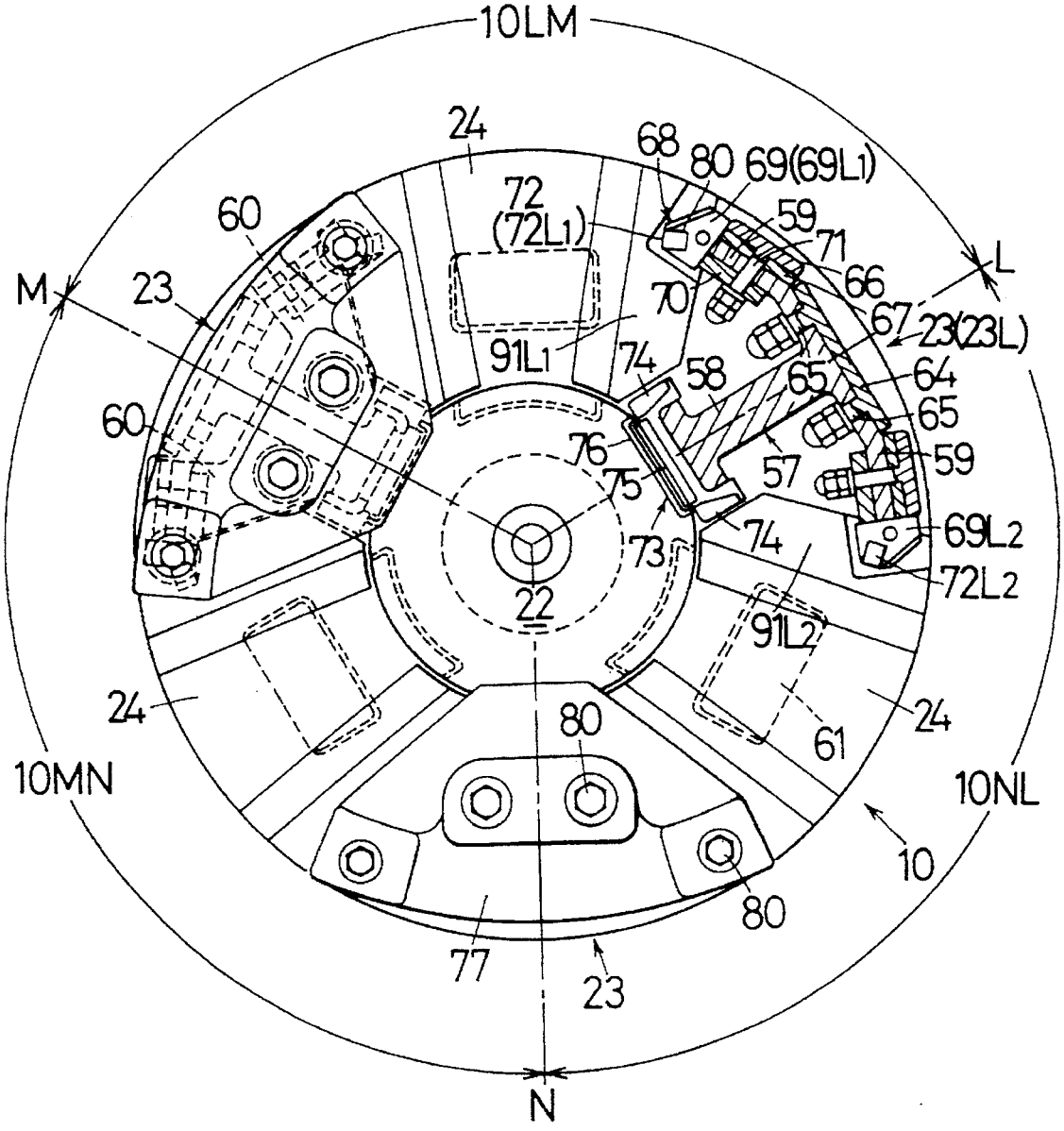
FIG. 4 is a horizontal cross-sectional view of FIG. 1.

FIGS. 4 and 5 illustrate the detailed structure of rotor 10. A liner 50 to protect the rotor body 21 is fittedly mounted on the outer periphery of the rotor body 21. Liner 50 is bolted to the rotor body. A flat plane 52 is formed as the top surface of the distributing cone-like body 22 in the center of the upper side thereof. The outer periphery of the distributing cone-like body 22 is formed as a tapered surface 53 around the rotor axis.

A circular recess 54 is formed on the lower side of the distributing cone-like body 22. Recess 54 engages with a circular step portion 55 formed on the top surface of the rotor body 21 thereby locating the body cone-like 22 at the proper position. The distributing cone-like body 22 has a bore 56 in the center thereof allowing an engaging portion of a suspending means (not shown) to be engaged therewith during assembly and disassembly.

Each wing 23 includes a support 57. Supports 57 are fixedly mounted on the rotor body 21 and are disposed on the outer peripheral zone around the distributing cone-like body 22. Supports 57 are provided as three bodies disposed in the three angular orientations equal on 120 degree circumferential spacing.

Each support 57 includes a radially extending portion 58, a circumferentially extending portion 59 and a plate portion 60. Radially extending portion 58 extends in the radial direction on the rotor body 21, while the circumferentially extending portion 59 generally extends oppositely in circumferential back-and-forth directions on the rotor body 21 from the outer portion of the radially extending portion 58.

By means of the plate portion 60 the radially extending portion 58 is integrally secured to the circumferentially extending portion 59. Discharge passage liners 24 are located between each pair of supports 57, 57 in the above described respective angular intervals. A projection 61 is provided on the lower side of the discharge passage liner 24. Projection 61 is fitted into a recess 62 provided on the upper side of the rotor body 21, thereby effecting the positioning of the discharge passage liner 24. When the discharge passage liner 24 is disposed on the rotor body 21 with the distributing cone-like body 22 placed at the proper position, a notch portion 63 is engaged with the discharge passage liner 24. This causes the distributing cone-like body 22 to press the discharge passage liner 24 against the rotor body 21.

A first wall liner 64 is fixedly mounted on the outside of each support 57. Studbolts 65 as integral screw members are provided for the first wall liner 64. Nuts are fittedly inserted into the studbolts 65 of the first wall liner 64, by which the first wall liner 64 is secured to the circumferentially extending portion 59 of the support 57. On the circumferentially extending portions 59 of the respective supports 57 are mounted second wall liners 66, third wall liner 67 and outer tip plates 68. Studbolts 71 as integral screw members are provided with the second wall liner 66. The third wall liner 67 is secured at the intermediate position between the second wall liner 66 and the circumferentially extending portion 59 by means of the studbolts 71 and nuts (not shown) fitted on the studbolts 71.

As shown in FIG. 4, super-hardness tips or non-super-hardness tips 72 are mounted on the base body 69 of the outer tip plates 68. A non-super-hardness tip 72 is made of hard steel or hard alloy, e.g., Cr-steel or Ni-Cr-steel, that is more easily worn but hard to chip because of its pliability. The expression, "to be hard to chip", means, in strength of material, that chipping wear is comparably less. On the other hand, the expression, "super-hardness", means that the super-hardness of steel or super-hardness of the alloy is more wear resistant but is easier to chip.

The expression, "to be easy to chip", means, in strength of material, that chipping wear is comparably more. Examples of super-hard alloys are known as sintered alloys, included in WC-Co series, WC-TiC-Co series, WC-TiC-TaC (NbC)-Co series, TaC-Ni series, Cr-Ni series that correspond in hardness to diamond and are made by means of a sintering method in which Fe-composition combined with soft carbide is molded under pressure and sintered after molding. It is apparent from the above definition that not only may alloy be applied for super-hardness tips, but fine ceramics, as well.

The two portions 59 extending oppositely in the circumferential back-and-forth direction are the same in structure. Inner tip plates 73 are disposed on the inner peripheral portion of the supports 57. These plates are U-shaped to receive the radially extending portion 58 of the wing support 57. Each inner tip plate 73 includes an inside tip and right and left side tips. These tips are made of material of the same kind as the above material for tips 72, that is super-hardness alloy or non-super-hardness alloy, as described above.

In the state where inner tip plate 73 is mounted on the support 57, the lower portion of the inside tip plate 73 is engaged with the chipping portion of the distributing cone-like body 22. Support 57 is covered by means of a top covering plate 77. A step portion 78 for positioning is formed on the lower side of the top covering plate 77. Step portion 78 is fitted into a recess formed on the plate portion 60 of the support 57, thereby the top covering plate 77 is positioned at the proper engaged position.

A downwardly bent portion 79 is formed as an inner side edge of the top covering plate 77. Inner tip plate 73 is secured to and between the downwardly bent portion 79 and the distributing cone-like body 22. Top covering plate 77 is affixed to the plate portion 60 of the support 57 and the base body 69 of the outer tip plates 68 by means of a bolt 80 and other bolts (not shown) at four positions.

FIG. 4 illustrates three centerlines L, M, N which are in different angular positions. Line L is different from line M by 120 degrees. Line M is different from Line N by 120 degrees. Line N is different from Line L by 120 degrees. Respective centerlines L, M and N are aligned with the centerlines of the respective radially extending portions 58, 58, 58 of the supports and are perpendicular to the rotational axis K of the rotor 10, meeting at one point on the axis K.

The three rotor portions 10LM, 10MN and 10NL of the rotor 10 between one selected centerline and the two other adjacent centerlines and between the two other centerlines are substantially congruent to each other. Wing 23L has symmetry with respect to the centerline L. Wing 23M has symmetry with respect to the centerline M. Wing 23 N has symmetry with respect to the centerline N. As an example, the base bodies 69 are given as a set of two base bodies 69L1 and 69L2 that are circumferentially symmetrical with respect to the centerline L. The other base bodies 69 are given as a set of two base bodies 69M1 and 69M2 that are circumferentially symmetrical with respect to the centerline M. The still other base bodies 69 are given as a set of two base bodies 69N1 and 69N2 that are circumferentially symmetrical with respect to the centerline N.

As such, all parts included in the rotor 10 are symmetrically located with respect to each centerline L, M, or N. Such symmetry is needed for high speed rotation of the rotor 10. The tips 72 are fixedly mounted on the two respective base bodies 69L1 and 69L2 as a set of two tips 72L1 and 72L2 that are symmetrical to each other with respect to the centerline L. Each of the other tips 72 are fixedly mounted on the respective other base bodies 69M1 and 69M2 as pairs of tips 72M1 and 72M2 that are symmetrical to each other with respect to the centerline M. The still other tips 72 are fixedly mounted on the respective two base bodies 69N1 and 69N2 as a pair of tips 72N1 and 72N2 that are symmetrical to each other with respect to the centerline N.

According to such a location of the tips, tip 72L1 and tip 72M2 are located in the rotor portion 10LM, tip 72M1 and tip 72N2 are located in the rotor portion 10MN and tip 72N1 and tip 72L2 are located in the rotor portion 10 NL. One group of tips 72L1, 72M1 and 72N1, that have the respective phases identical with one another in the rotational direction, are made of super-hardness material as defined above. The other group of tips 72L2, 72M2 and 72N2, that have the respective phases identical with one another in the rotational direction, are made of ordinary material that is non-super-hardness material as defined above. One group of tips 72L1, 72M1, 72N1 and the other group of tips 72L2, 72M2, 72N2 are all replaceable. It is not necessary to apply a super-hardness material for the inner tip plates 73.

Dead spaces 91L, 91M and 91N occur within the respective wings 23L, 23M and 23N on the both sides in the circumferential direction. One group of dead spaces 91L1, 91M1 and 91N1 are in the same phase in the rotational direction. The other group of dead spaces 91L2, 91M2 and 91N2 are in the same phase in the rotational direction. The respective phases of the dead spaces 91L1 and dead spaces 91L2 are different from each other.

Dead space 91L1 and dead space 91L2 are symmetrical with respect to the centerline L. Dead space 91M1 and dead space 91M2 are symmetrical with respect to the centerline M. Dead space 91N1 and dead space 91N2 are symmetrical with respect to the centerline N. Each dead space is located between one of the wings 23 and one of the discharge passage liners 24.

(Operation of the Embodiment)

Rotor 10 is driven at a high speed by a driving motor (not shown). Raw rocks are supplied onto the rotor through the inlet opening 2 and through the guide chutes 7 and 8. The supplied raw rocks are distributed by the distributing cone-like body 22 along the discharge passages formed between the respective two adjacent wings. Such distributed raw rocks are accelerated with a given centrifugal force. This causes the rocks to be discharged from the peripheral end of the rotor.

Such discharged raw stones are crushed into stones with smaller diameters by collision with one of the anvils 32*a*, 32*b*, 32*c*, 32*d*. Some crushed stones are accumulated on the dead stock forming plate 30 of the dead stock spaces 34*a*, 34*b*, 34*c*, 34*d*. At the beginning of the operation, accumulated crushed stones do not perfectly form a dead stock. In a short time, a sufficient amount of stones are accumulated on the dead stock forming plate 30 to form a perfect dead stock. As shown in FIG. 2, four dead stocks 42, 42, 42, 42 are formed with respective angles of repose. As a result, discharged raw stones are crushed by collision with such formed dead stocks.

Other dead stocks are also formed with respect to the rotor 10 by stones that are prevented from discharging by the supports 57 and the circumferentially extending portion 59. Such dead stocks have the respectively specified angles of repose under operation of centrifugal force and gravitational force. Collision of raw stones with anvil 32 which has a high degree of hardness and is made of manganese steel causes discharged stones to be crushed into relatively small radii, while collision of raw stones with dead stock 42 which has a low degree of hardness and is formed of accumulated stones causes discharged stones to be crushed into relatively large radii. It is not accurate to say that the collision of a stone with a dead stock is to be expressed as "crush". A stone colliding with a dead stock is reduced little in radius, but is merely made smooth because of surface wear.

Changing the horizontal distance between each anvil 32 and the rotor 10 not only makes stones different in material or size to be of the same grain size, but also makes stones equivalent in material or size to be of different grain size. A decrease in the number of the spacers 35 enables the achievement of crushed stones of a small grain size, while an increase in the number the spacers 35 enables the achievement of crushed stones of a large grain size. Otherwise, alteration of the inner radius of the adjusting ring 36 enables the change of the grain size of crushed stones.

Raw stones, that are accelerated and rolled on the surface of the dead stocks accumulated on the dead stock forming plate 30 in the dead stock spaces 34*a*, 34*b*, 34*c*, 34*d*, collide with tips 72. Tips 72 wear less easily but are easier to chip when the thrown raw stones are of large grain size. On the other hand, tips 72 are harder to chip but easier to wear when the thrown raw stones are of small grain size.

Controlling the operation of a crusher according to the present invention enables the production efficiency to increase. Super-hardness tips 72L1, 72M1, 72N1 are applied as tips mounted in the dead stock spaces 91L1, 91M1, 91N1 where dead stocks are formed with respect to the rotor when it is rotating in one direction (i.e., the clockwise direction), while non-superhardness tips 72L2, 72M2, 72N2 are applied as tips mounted in the dead stock spaces 91L2, 91M2, 91N2 where dead stocks are formed with respect to the rotor when it is rotating in the reverse direction (i.e., the anti-clockwise direction). Operation control includes means to rotate the rotor 10 in the clockwise direction or to rotate the rotor 10 in the anti-clockwise direction in correspondence to the grain size or grain size distribution of the raw stones supplied to the crusher.

For the large size of stones being produced, that is, raw stones being of large size, the rotor is rotated in the clockwise direction as seen in FIG. 4. Most stones collide with the non-super-hardness tips 72L2, 72M2, 72N2 that are less worn because of a lower collision frequency and hard to chip because of its physical properties.

For the small size of stones being produced, that is, raw stones being of small size, the rotor is rotated in the anti-clockwise direction. Most stones collide with the non-super-hardness tips 72L1, 72M1, 72N1 that are hard to chip because of their small moments and of less wear because of their physical properties, despite a higher collision frequency.

Such an operation method may be conducted on a regular basis but, alternatively, may be performed intermittently on an irregular basis in combination with the regular operation. When large sized stones are produced, the rotor is rotated in the clockwise direction and when small sized stones are produced, the rotor is rotated in the anti-clockwise direction. In consideration of the degree of abrasion to be experienced by the non-super-hardness tips 72L1, 72M1, 72N1 or by the non-super-hardness tips 72L2, 72M2, 72N2, regular rotation or irregular rotation may be operated. Such a combination of regular operation with irregular operation results in an extension in the common tip life.

A single crusher is not always used. A number of crushers according to the present invention may be simultaneously or synchronously operated. It is normal that a number of crushers are operated in relation to each other. Simultaneous operation enables processes to be synchronous in which stones of a large grain size are in multi-processes crashed into stones of a small grain size. Rotors are rotated in the respective rotational directions in the respective processes: a first step crasher being rotated in the clockwise direction; a second step crasher being rotated regularly in one direction or irregularly in alternate directions; a third step crusher being rotated in the anti-clockwise direction. Such a group-control operation results in an extension of the tip life.

What is claimed is:

1. A vertical shaft type impact crusher comprising, a casing body (1), a rotor (10) mounted on said casing body (1), being reversely rotatable for giving stones supplied thereto centrifugal force, anvils (32*a*, 32*b*, 32*c*, 32*d*) mounted circumferentially around said rotor (10), said rotor (10) including multiple pairs of tips (72L,72M, 72N), the respective pairs of tips including first and second tips being located in symmetry with respect to radial axes disposed at equal angular intervals, said radial axes extending from the rotational axis of the rotor (10) in the radial direction, the first tips (72L1,72M1,72N1) of each of said pairs being directed forwardly in the rotational direction of said rotor with respect to the respective radial axes (L,M,N) and being made of hard material in comparison with the material of the second tips, and said second tips (72L2,72M2,72N2) of each of said pairs being directed backward in the rotational direction of said rotor and being made of a softer material in comparison with said hard material.

2. The vertical shaft type impact crusher of claim 1 further comprising:

a dead stock forming plate (30) forming dead stock spaces (34*a*, 34*b*, 34*c*, 34*d*) thereon circumferentially around said rotor (10) to accumulate crushed stone therein, said dead stock forming plate (30) being located around said rotor (10) and having a bore (31) in which said rotor (10) is located.

3. Vertical shaft type impact crusher of claim 2, still further comprising:

an adjustable means for adjusting the distance between said respective anvils (32*a*, 32*b*, 32*c*, 32*d*) and said rotor (10), said adjustable means being located between said respective anvils (32*a*, 32*b*, 32*c*, 32*d*) and the inner surface of said casing body (1).

4. Vertical shaft type impact crusher of claim 2 or claim 3, wherein said bore (31) is circular, and still further comprising:

a ring for adjusting the the volume of said dead stock spaces (34*a*, 34*b*, 34*c*, 34*d*), said ring being replaceably mounted on the peripheral edge of said circular bore.

5. Vertical shaft type impact crusher comprising:

a casing body (1), a rotor (10) mounted on said casing body (1), being reversely rotatable for giving stones supplied thereto centrifugal force, dead stock spaces (34*a*, 34*b*, 34*c*, 34*d*) for accumulating crushed stones therein, said dead stock spaces being located circumferentially around said rotor (10), anvils (32*a*, 32*b*, 32*c*, 32*d*) for crushing stones discharged from said rotor, said anvils being mounted in the circumferential area around said rotor (10), said anvils being located between said respective dead stock spaces in mutually spaced disposition peripherally around said rotor (10), said rotor (10) including multiple pairs of tips (72L,72M, 72N), the respective pairs of tips including first and second tips being located in symmetry with respect to radial axes disposed at equal angular intervals, said radial axes extending from the rotational axis of the rotor (10) in the radial direction, the respective first tips (72L1,72M1,72N1) of each of said pairs being directed forwardly in the rotational direction of said rotor with respect to the respective radial axes (L,M,N) and being made of hard material in comparison with the material of the second tips, and the second tips (72L2,72M2,72N2) of each of said pairs being directed backward in the rotational direction of said rotor and being made of a softer material in comparison with said hard material.

6. A method for operating a vertical shaft type impact crusher including a rotor rotatable in a casing body having stone crushing anvils disposed at spaced locations thereabout and dead stock spaces between said anvils, said method comprising the steps of:

providing pairs of tips on said rotor, each including a first tip directed in one rotational direction and formed of a hard material, and a second tip directed in an opposite rotational direction and formed of a material softer than that of said first tip, supplying raw stones to said crusher, determining the grain size of said raw stones; and rotating said rotor in said one direction or said opposite direction in response to the grain size of the raw stones.

7. The method of operating a vertical shaft type impact crusher as recited in claim 6, wherein rotation of said rotor in said one direction or in said opposite direction occurs in response to the degree of wear of said first tips (72L1,72M1,72N1) in comparison with that of said second tips (72L2,72M2,72N2).

* * * * *